United States Patent [19]

Garza

[11] 3,984,101

[45] Oct. 5, 1976

[54] SELF-FORCE RESISTER TYPE EXERCISING DEVICE

[76] Inventor: Alfonso Garza, P.O. Box 256, Yosemite, Calif. 95389

[22] Filed: Feb. 18, 1975

[21] Appl. No.: 550,859

[52] U.S. Cl. ..... 272/126; 272/144; 128/33; 128/25 R; 272/116; 272/134

[51] Int. Cl.[2] ..... A63B 21/00

[58] Field of Search ..... 272/57 R, 60 R, 79 R, 272/57 A, 79 D, DIG. 4, 80, 116, 93, 126, 134, 120, 121, 144; 128/25 R, 33; 254/175.5

[56] References Cited

UNITED STATES PATENTS

| | | | |
|---|---|---|---|
| 2,533,273 | 12/1950 | MacGregor | 272/58 |
| 2,631,582 | 3/1953 | Bensfield | 128/25 R |
| 3,379,434 | 4/1968 | Guzaldo | 272/144 |
| 3,540,436 | 11/1970 | Hueftle | 128/25 R |
| 3,857,561 | 12/1974 | Cecchettini et al. | 272/144 |

FOREIGN PATENTS OR APPLICATIONS

| | | | |
|---|---|---|---|
| 499,624 | 2/1954 | Canada | 272/57 R |
| 18,916 | 1895 | United Kingdom | 128/25 R |

OTHER PUBLICATIONS

Photograph from Washington Post; 2/18/72; p. 1E.

*Primary Examiner*—Richard C. Pinkham
*Assistant Examiner*—William R. Browne
*Attorney, Agent, or Firm*—Huebner & Worrel

[57] ABSTRACT

An exercising machine for use in simultaneously stressing muscle groups found in the limbs and trunk of a human user. The machine is characterized by a table having a bodysupporting surface including a body vibrator and an upstanding yoke adapted to receive the shoulders of a body in a supporting relationship; and a hoist for simultaneously stressing muscle groups found in the legs and trunk of a user's body, including a hand-driven windless mounted on the table substantially beneath the yoke in a position to be manipulated by the user as he is supported on the table in a face-down orientation, a sheave supported above the table, and a flexible line extended from the windless, trained about the sheave and adapted to be connected to the ankles of the user, whereby the user simultaneously lifts his trunk and legs above the plane of the back of his shoulders through a manipulation of the windless.

6 Claims, 9 Drawing Figures

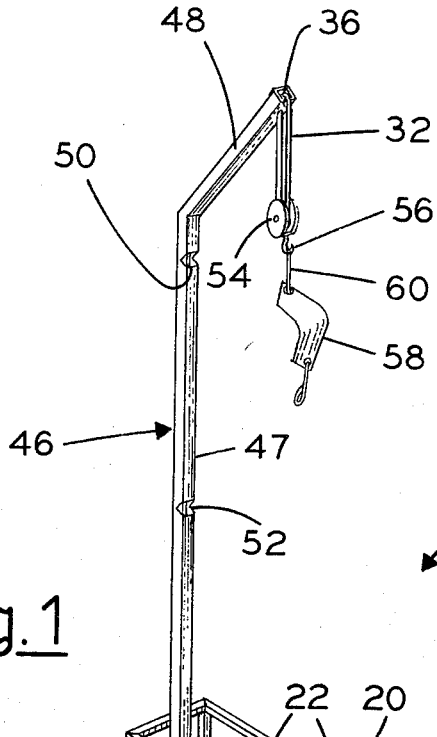
Fig. 1
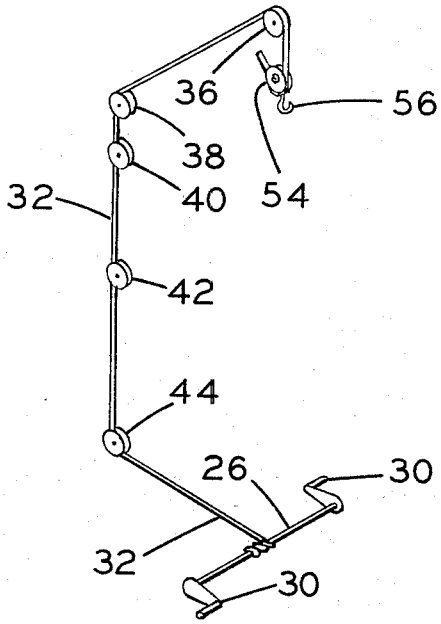
Fig. 3
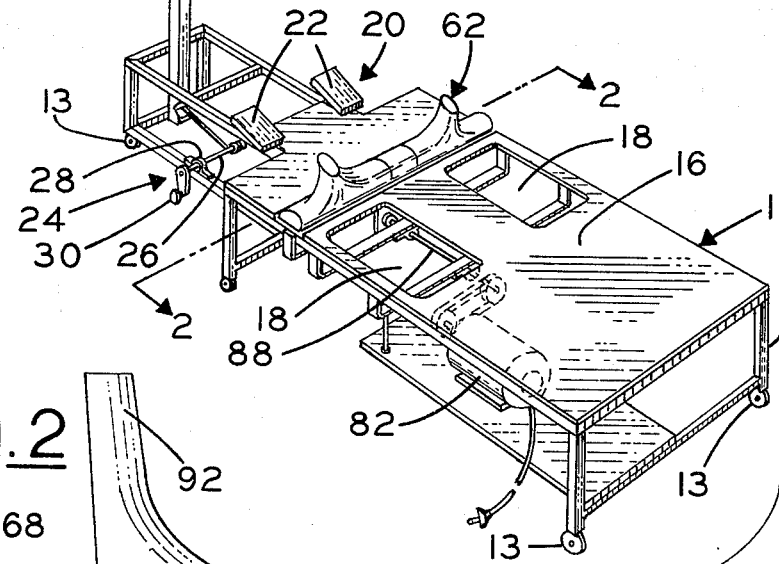
Fig. 2
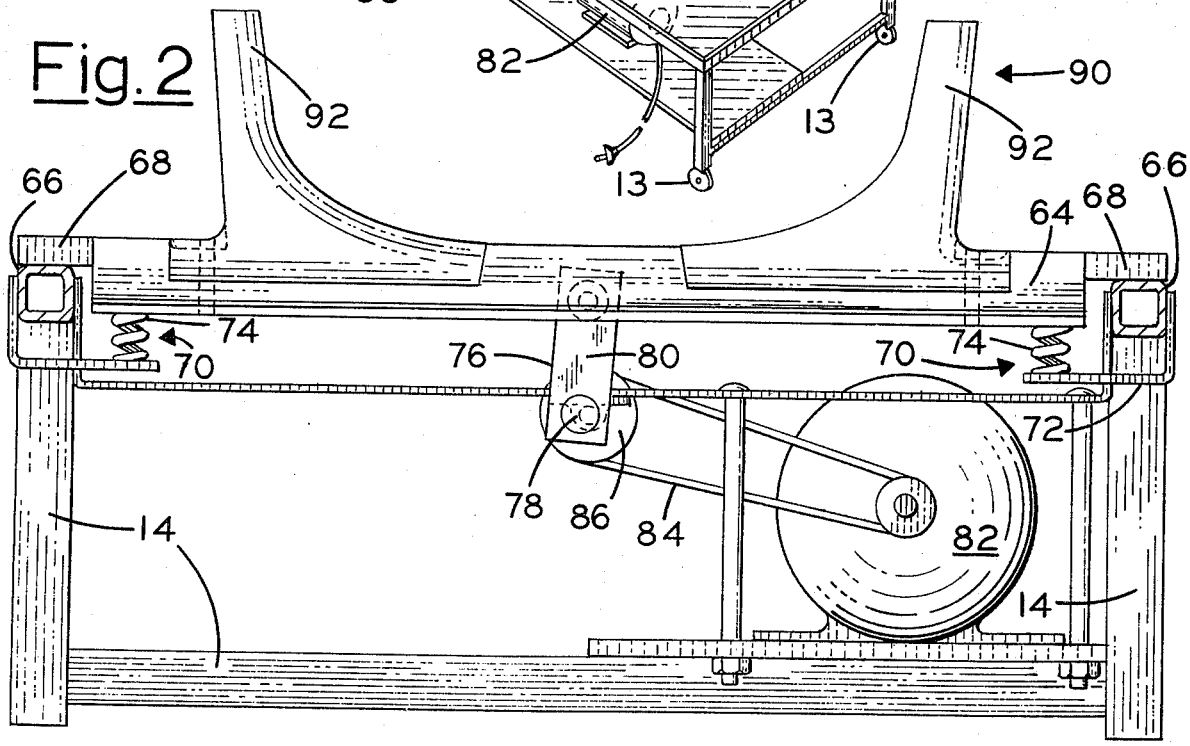

SELF-FORCE RESISTER TYPE EXERCISING DEVICE

BACKGROUND OF THE INVENTION

The invention generally relates to exercising machines and more particularly to an exercising machine adapted to be employed by a user for strengthening muscle groups found throughout the limbs and trunk of the user.

It has long been recognized that certain maladies which seem to plague human beings are directly traceable to poor muscular and skeletal conditioning. Therefore, a great deal of attention recently has been given to techniques and machines for use in strengthening various muscle groups found at various locations throughout the human body.

The prior art, of course, includes a large number of exercising machines adapted to be employed by a user for strengthening various muscle groups found in the trunk and limbs of the user. Frequently, such machines have a capability for initially stressing the large voluntary muscles of the body for determinable lengths of time, whereupon blood is forced from the muscles, and, thereafter, permitting the muscles to relax for enhancing a return of oxygen-laden blood.

Often, the machines disclosed by the prior art are so designed that they serve to work against tthe forces applied by the user. Such machines include weighted, spring-loaded and friction-retarded devices which oppose selected groups of muscles, while the remaining muscles in the body and limbs are substantially relaxed. Thus, it is necessary for a user to utilize a large number of machines or to utilize a given machine in a large number of configurations in order to tone or strengthen muscle groups found at various locations in his trunk and limbs.

For example, machines designed to strengthen muscle groups found in the thighs often permit muscle groups found in the remaining portions of the body to remain relaxed, while the muscles of the thighs are repetitiously stressed and relaxed. Similarly, machines designed to strengthen the muscle groups found in arms often permit the legs of the user to remain substantially relaxed throughout the operation of the machine. Similarly, muscle groups found in the lower and upper back, and shoulders are stressed while the muscle groups of the user's legs, arms and abdominal muscles remain relaxed.

It, therefore, can be appreciated that there currently exists a need for a simplified machine which readily can be utilized for stressing a maximum number of muscle groups found throughout the trunk and limbs of the user, for thereby reducing the time required in achieving a "good work out".

It is, therefore, an object of the instant invention to provide an exercising machine which overcomes the aforementioned difficulties and disadvantags without sacrificing the advantageous characteristics of the machines disclosed in the prior art.

OBJECTS AND SUMMARY OF THE INVENTION

It is, therefore, an object of the instant invention to provide an exercising machine which overcomes the aforementioned objections and disadvantages.

Another object is to provide an exercising machine adapted for use in simultaneously strengthening muscle groups found in the limbs and trunk of a human user.

It is another object to provide an exercising machine adapted for use in simultaneously strengthening muscle groups found in the thighs, abdomen, back and arms of a user.

It is another object to provide an exercising machine adapted to be manipulated by a user oriented in a face-down position and manipulated for lifting his legs and lower back above the plane of his shoulders.

It is another object to provide an exercising machine adapted to be manipulated by a user supported in a face-down orientation for lifting his legs and lower back above his head while arching his back for achieving a hyperextension of back muscles, while simultaneously stressing muscle groups found in the arms, shoulders, abdomen and thighs.

These together with other objects and advantages are achieved through the use of an exercising machine including a table for supporting a user in a face-down orientation, and a windless disposed beneath the table having a line trained about a sheave suspended above the table and attached to the ankles of the user, whereby a manipulation of the windless serves to lift the legs of the user and hyperextend muscle groups found in the back, particularly the lower back.

BRIEF DESCRIPTION OF THE DRAWINGS

FIG. 1 is a perspective view of an exercising machine which embodies the principles of the instant invention.

FIG. 2 is a cross-sectional view, taken generally along line 2—2 of FIG. 1, illustrating the vibrator shown in FIG. 1.

FIG. 3 is a schematic view illustrating rigging provided for the machine.

DESCRIPTION OF THE PREFERRED EMBODIMENT

Figure 4:
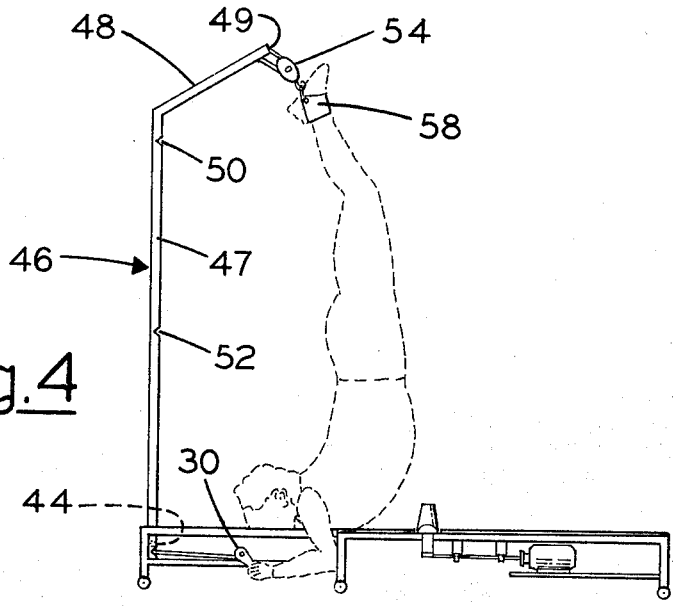
FIGS. 4, 5 and 6, collectively, illustrate alternate positions for the rigging whereby a user's body may be subjected to different levels of stress.

Referring now to the drawings wherein like reference characters designate like or corresponding parts throughout the several views, there is shown in FIG. 1 a perspective view of an exercising machine, generally designated 10, which embodies the principles of the instant invention.

The machine 10 includes a table 12, supported for rolling motion along a supporting floor, not designated, by suitable casters 13. The table 12 includes a base framework 14 upon which is mounted a padded cover 16. As a practical matter, the framework 14 is formed of tubular stock material welded or otherwise secured together in a manner well understood by those familiar with the fabrication of such devices. The padded cover 16 formed of any suitable padding material superimposed upon a planar support member, such as reinforced plywood and the like, not shown. Since the particular materials and techniques employed in the construction of the table 12 form no specific part of the instant invention, a more detailed description thereof is omitted in the interest of brevity. It is important, however, to understand that a pair of mutually spaced reliefs 18 are formed in the cover 16 and accommodate unencumbered movement of a user. Where desired, the reliefs 18 are employable for mounting structure which forms no part of the instant invention.

Near one end of the table 12 there is provided a yoke, generally designated 20, which serves to receive the shoulders of a user in a supporting relationship. As herein employed, the term "shoulders" is not limited to the joints through which the arms are connected with the trunk of the user's body but refers to those regions of the trunk which include the bones, joints and muscles through which the arms of the user are connected with his trunk.

The yoke 20 includes a pair of mutually spaced, inclined shoulder supports 22 which engage a user's shoulders when the user is supported in a face-down orientation on the cover 16. As a practical matter, the shoulder supports 22 are suitably padded in order to reduce a likelihood of injury to the user, and are spaced apart a distance sufficient to accommodate a positioning of the user's face therebetween, while permitting the arms of the user to extend downwardly at opposite sides of the yoke 20.

Mounted on the table 12, beneath and forwardly of the shoulder supports 22, there is a windless, designated 24. The windless 24 includes transverse take-up bar 26 supported at each of its opposite ends by a suitable bearing block 28, only one of which is shown in FIG. 1. A crank-handle 30 is extended in opposite directions from each of the opposite ends of the bar 26 in order to facilitate manual operation.

As a practical matter, each of the crank-handles 30, which are extended from the opposite ends of the bar 26, includes a radius rod having a rotatable knob, not designated, affixed to the extended end thereof and adapted to be grasped by a user. Consequently, it is to be understood that a user disposed in a face-down orientation on the cover 16, with his shoulders seated against the shoulder supports 22, is properly positioned for grasping the crank-handles 30.

A line 32, having one end thereof affixed to the take-up bar 26, is trained about a sheave 34 suspended by the line above the table 12. In order to support the sheave 34 in suspension, the line 32 is trained about a plurality of sheaves, designated 36 through 44. The sheaves 36 through 44 are mounted in a tubular stanchion 46 rigidly affixed to the table 12. The stanchion 46 includes a vertically oriented segment 47 which terminates in a cantilevered, inclined segment 48, including access opening 49 for the sheave 36.

As a practical matter, the stanchion 46 is formed of suitable tubular stock material with the sheaves 36 through 44 being seated inside the stanchion and supported for rotation by suitable pins, not designated. Moreover, it is important to note that immediately adjacent the sheaves 40 and 42 there is provided an access opening 50 and 52, respectively. Thus, access to sheaves 40 and 42 is facilitated.

Figure 7:
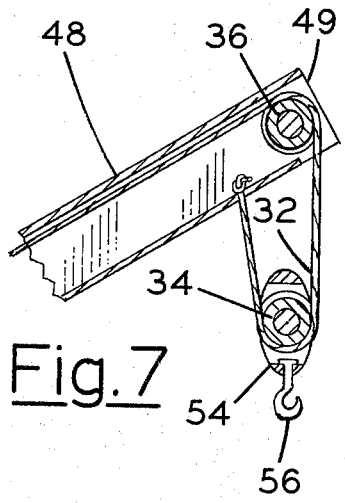
FIGS. 7, 8 and 9 further illustrate alternate configurations for the rigging when employed in the manners illustrated in FIGS. 4, 5 and 6, respectively.

It will be noted that the sheave 34, about which the line 32 is trained, as illustrated in FIG. 7, comprises a pulley for a block 54 having a hook 56 depending therefrom. Since block 54 is of known design and construction, a detailed description of the block 54 is omitted in the interest of brevity. However, it is to be understood that the block 54 is provided with removable side plates, not designated, through which access to the sheave 34 is afforded for facilitating a coupling and decoupling of the sheave with the line 32. As a practical matter, the distal end of the line 32 is connected with the cantilevered segment 48 of the stanchion 46. It will, therefore, be appreciated that the line 32 is extended from the stanchion 46 in a U-shaped configuration with the sheave 34 being seated in the bite of the line.

In order to couple the block 54 with the feet of a user, there is provided a flexible cuff 58 adapted to be wrapped in a capturing relation about the ankles of the user and connected with the hook 56 through a suitable link 60.

It should, in view of the foregoing, be apparent that a user lying prone on the cover 16 may secure the cuff 58 about his ankles, attach the cuff to the hook 56 suspended from the block 54, via the link 60, and then position himself in a face-down orientation on the shoulder supports 22 preparatory to manipulating the windless 24.

Of course, as a user lifts himself, a great deal of stress is placed on the muscle groups found in the user's thighs, abdomen, and arms. Simultaneously, selected muscle groups, particularly in the lower back, are subjected to hyperextension. Due to the stressing effect, circulation through the muscles is reduced. In order to enhance circulation, and thus enhance muscle development, once stress is removed, there is provided a vibrator 62 which serves to receive the midportion of the trunk of the user and applying thereto vigorous vibratory motion, which is transmitted throughout the user's body.

The vibrator 62 includes a transverse bar 64 supported on a pair of horizontal sills, designated 66, of the base framework 14 by a pair of horizontally extended wear plates 68 and a resilient suspension system 70. The suspension system 70 includes a pair of right-angle bracket members 72 welded or otherwise rigidly affixed to the sills 66 and extended inwardly beneath the bar 64. Suitable compression springs 74 are mounted on the bracket 72 in a supporting relationship with the lowermost surface of the bar 64 for thus providing a resilient support for the bar.

Oscillating motion is imparted to the bar 64 through a drive train 76 which includes an eccentric 78 connected with the bar 64 through a drive link 80. The link 80 is pinned to the bar 64, through a suitable bearing pin, not designated, while the eccentric 78 is driven in rotation by an electrically energizable motor 82 connected therewith through a belt-and-sheave drive assembly. The belt-and-sheave drive assembly includes a belt 84 trained about a sheave 86 mounted on a drive shaft 88 provided for the eccentric 78. It should, therefore, be appreciated that the elliptical motion is imparted to the vibrator bar 64 in response to the motor 82 being energized for imparting rotary motion to the drive shaft 88.

Transmission of vibratory motion from the bar 64 to the trunk of the user is enhanced by means of a yoke 90, FIG. 2, which includes a pair of upstanding horns 92 spaced apart a distance suitable for receiving therebetween the trunk of the user, whereby the opposite sides of user are engaged.

OPERATION

It is believed that in view of the foregoing description, the operation of the device will readily be understood and it will be briefly reviewed at this point.

With the machine 10 assembled in the manner hereinbefore described, a user places himself on the padded cover 16 and attaches to his ankles the cuff 58. Thereafter, a user attaches the cuff 58 to the hook 56, through the link 60, and positions himself in a face-down position with his shoulders resting upon the yoke 20 and his hands in a position to manipulate the windless 24. The force applied to the windless for imparting rotary motion to the take-up bar 26 is, of course, applied against the weight of the legs and trunk of the user, consequently, the muscles of the user's arms are stressed as the windless is manipulated for elevating the legs and trunk of the user.

Figure 5:
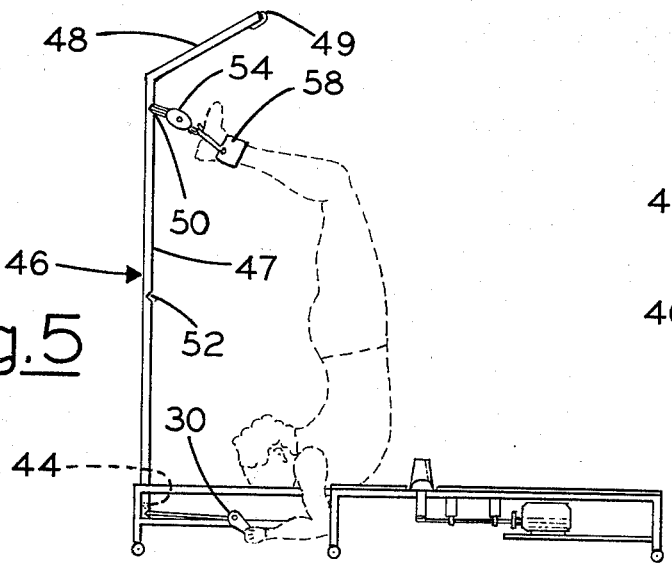
Figure 8:
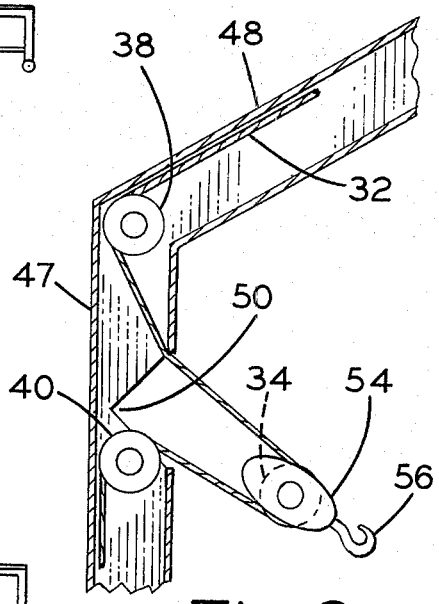
Figure 6:
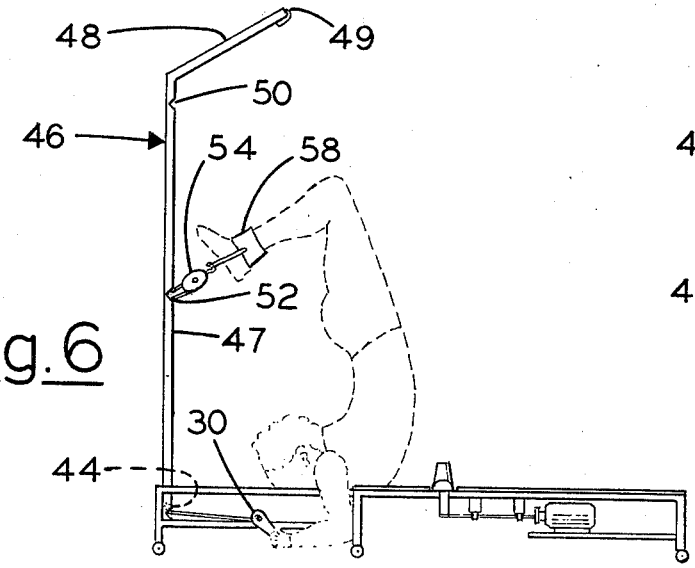
Figure 9:
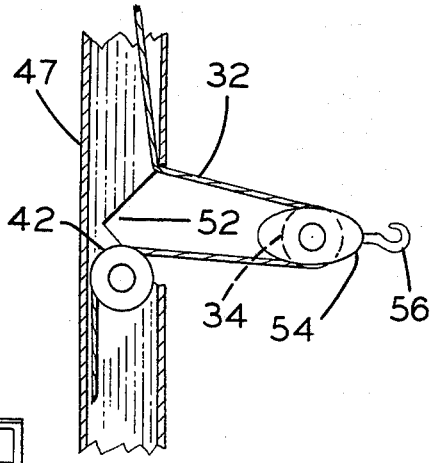

As the trunk of the user is elevated, various muscle groups found in the upper legs, abdomen and back of the user are subjected to stress. Where the block 54 is elevated toward the access opening 49, located at the distal end of the cantilevered segment 48, minimal stress is applied to the muscle groups. As conditioning occurs, it is desirable to remove the block 54, draw the line 32 taut about the sheave 36, extract a bite of the line 32 through the access opening 50, as illustrated in FIG. 5, and reposition and sheave 34 in the bite of the line extended from the access opening 50. In this configuration, it is possible to place a greater level of stress on the various muscle groups, aforementioned, as well as to subject the back muscles to a greater degree of hyperextension.

Once further conditioning is achieved, the block 54 is again removed from the bite of the line, as it is extended through the access opening 50, and the line 32 then extended from the access opening 52 and the sheave again coupled therewith by inserting it into the bite drawn through this access opening.

Regardless of which access opening the line 32 is extended, it will be appreciated that the body of the user is drawn up relatively slowly as the windless is manipulated. Thus a great deal of stress is placed on the various muscle groups for a substantial period of time. Once the windless is released so that the body of the user can again assume a prone, relaxed position, blood is permitted to return to the previously stressed muscles. It is desirable to enhance a return of oxygen-laden blood to the stressed and now relaxed muscles. Consequently, the vibrator 62 is energized in response to a closing of an electrical switch, not shown, which causes the motor 82 to drive the vibrator 62 so that the bar 64 is caused to rapidly advance in an elliptical path for thus causing the body of the user to vibrate. This vibration is then transmitted through the body skeleton to the various groups of muscles previously stressed, for thereby enhancing the flow of oxygen-laden blood through the previously stressed muscle groups. Such, of course, expedites muscle building functions of the body.

In view of the foregoing, it should readily be apparent that the machine of the instant invention provides a practical, economic, and simple solution to the problem of maximizing muscle conditioning utilizing minimum amounts of time.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. An exercising machine adapted for use in strengthening muscle groups found in the limbs and trunk of a human user comprising:

A. means for supporting the body of a user including a table having a substantially horizontally oriented body-supporting surface and an upstanding support adapted to receive the shoulders of the body of a user disposed in a face-down, substantially horizontal orientation; and B. means connected to the table and adapted to lift the legs and trunk of a user including a hand-driven windless mounted on said table substantially forward of said support and beneath the plane of the top of said table in a position to be manipulated by a user supported by said surface in a face-down orientation, a sheave supported substantially above the support, a flexible line extended from said windless and trained about said sheave, and means adapted to connect an extended portion of the line to the legs of a user supported by said surface, whereby the trunk and legs of a user are lifted above the plane of a user's shoulders in response to a manipulation of the windless.

2. The machine of claim 1 further comprising muscle vibrating means mounted on said table and adapted to impart vibratory motion to the trunk of a user supported on said table for thereby enhancing the circulation of blood through the muscles of the body of a user.

3. The machine of claim 2 further comprising means for supporting the sheave at selected elevations including a stanchion of a tubular configuration having mounted thereon a plurality of vertically spaced sheaves and means defining an access opening disposed adjacent to each of said sheaves.

4. The machine of claim 3 wherein said muscle vibrating means includes a movable panel transversely related to said body-supporting surface and an upstanding yoke affixed to said panel for receiving the trunk of a user.

5. The machine of claim 4 wherein said windless comprises an elongated bar transversely related to said table, a radius rod extended from each of the opposite ends thereof, and means defining a handle affixed to each of said radius rods.

6. The machine of claim 1 wherein said means adapted to connect the extended end of a line to the legs of said user includes a flexible cuff adapted to be connected to the ankles of the user.

* * * * *